United States Patent [19]

Swinney et al.

[11] Patent Number: 4,964,330

[45] Date of Patent: Oct. 23, 1990

[54] OIL FILTER ACCESSORY

[76] Inventors: Gary D. Swinney, 14 Provence, Lake Saint Louis, Mo. 63367; Richard H. Chenot, 149 Hineman, St. Charles, Mo. 63301

[21] Appl. No.: 419,115

[22] Filed: Oct. 10, 1989

[51] Int. Cl.[5] ..... B25B 13/52

[52] U.S. Cl. ..... 81/64; 81/3.43; 81/3.44; 81/3.4; 81/125

[58] Field of Search ..... 81/3.43, 3.44, 64, 120, 81/3.4, 90.1, 90.3, 176.2, 125, 121.1, 124.7, 124.4

[56] References Cited

U.S. PATENT DOCUMENTS

| | | | |
|---|---|---|---|
| 919,599 | 4/1909 | Lafferty | 87/90.3 |
| 2,956,462 | 10/1960 | Paul | 87/64 X |
| 3,066,559 | 12/1962 | Harvel et al. | 87/436 |
| 3,385,141 | 5/1968 | Norman | 87/120 |
| 4,266,452 | 5/1981 | Crist | 87/124.7 |
| 4,300,414 | 11/1981 | Boudreau et al. | 87/64 |
| 4,552,040 | 11/1985 | Bang | 87/3.43 |
| 4,643,053 | 2/1987 | Rhodes | 87/3.44 X |
| 4,660,445 | 4/1987 | Windom | 87/3.43 |

*Primary Examiner*—James G. Smith

*Attorney, Agent, or Firm*—Polster, Polster and Lucchesi

[57] ABSTRACT

An oil filter accessory is disclosed to facilitate installation and/or removal of an oil filter from an automobile engine or the like. The oil filter accessory includes a housing having at least one open adapted to fit over canister-type oil filter. The housing is capable of being locked relative to the oil filter to secure the housing against the rotation relative to the oil filter. The locking may be accomplished by a suitable circumferential clamp, pivoting locking lever(s), internal locking surfaces or other equivalent structure to prevent rotation of the housing relative to the oil filter. Suitably configured and dimensioned hand wrenching elements are operably associated with the housing to enable a user to physically grip and rotate the oil filter in either direction for tightening or loosening same relative to the automobile engine or the like.

25 Claims, 4 Drawing Sheets

OIL FILTER ACCESSORY

BACKGROUND OF THE INVENTION

The present invention relates to an oil filter accessory or wrench, and more particularly to a hand operated oil filter accessory or wrench which facilitates installation and/or removal of an oil filter relative to an automobile engine or the like.

Canister-type oil filters are typically used and replaced, as needed, in automobile engines or the like. Oil filter installation and removal has always been a relatively difficult task. During installation of the oil filter, the limited space and surrounding environment of the oil filter may inhibit the ease with which the oil filter may be conveniently and quickly installed. Removal of the oil filter, on the other hand, may be exacerbated not only by the location and surrounding environment of the oil filter, but also because oil filters sometimes tend to become frozen in-place. There are also situations encountered where the engine has only been recently turned off, leaving the engine and the oil filter hot. Even where certain types of tools can be used to break the filter loose, the oil filter may not be able to be picked up by hand, if it is still hot.

Oil filter installation and removal has become increasingly difficult with the introduction of smaller downsized, front wheel drive passenger cars. In such cars, the space around the oil filter is normally limited, allowing little more than space for a hand to be positioned around the oil filter. Since most oil filters can not be removed by hand pressure alone, removal tools are generally necessary. At present, there are removal tools requiring a fixed handle or socket wrench which are not only difficult to use, but such tools may also interfere with the surrounding parts and/or environment surrounding the oil filter.

Some examples of such prior art tools are shown, for example, by U.S. Pat. Nos. 1,711,225; 4,350,063; and 4,552,040, each of which show a circumferential clamp-type device with an interconnected tool such as a lever, handle or screw driver that assists in tightening or loosening the cable clamp device when it is desired to install or remove same relative to an oil filter. U.S. Pat. No. 4,643,053 also discloses a housing adapted to grip an oil filter, with a separate tool used to engage the housing in order to tighten or loosen same from an oil filter. In all of these prior art examples, the interconnected or separate tool is difficult to use in tight and confined spaces, such as the smaller, downsized front wheel drive cars. Moreover, such devices are difficult to use in any environment, with no assurance that the oil filter will be installed and removed according to the manufacturer's specifications.

SUMMARY OF THE INVENTION

Among the several objects and advantages of the present invention include:

The provision of an oil filter accessory which overcomes the aforenoted deficiencies of prior art devices;

The provision of a new and improved oil filter accessory or wrench which facilitates easy and accurate installation of an oil filter, while at the same time, enabling an oil filter to readily removed;

The provision of the aforementioned oil filter accessory or wrench which, in most cases, allows an oil filter to be installed and removed using hand pressure solely, without the need for tools such as extended handles or the like;

The provision of the aforementioned oil filter accessory or wrench which is also constructed to permit a pry bar or other tool to break apart the oil filter from the engine block in the event the oil filter is frozen in place;

The provision of the aforementioned oil filter accessory or wrench which corporates a hand configured wrench to enable a user to readily and accurately install an oil filter according to the manufacturer's specifications, while also enabling the oil filter to be readily removed for replacement thereof;

The provision of the aforementioned oil filter accessory or wrench which is capable of being adjustably mounted and secured relative to at least several different sizes of canister-type oil filters, in order to accommodate to a range of oil filter sizes/dimensions; and The provision of the aforementioned oil filter accessory or wrench which may be integrally molded in a one-piece construction with an associated locking element, that is simple and easy to manufacture, has little or no instructions to use and operate; is durable and long lasting; and is otherwise well adapted for the purposes intended.

Briefly stated, the oil filter accessory of the present invention facilitates installation and/or removal of an oil filter from an automobile engine or the like that includes a housing having at least one open end adapted to fit over an oil filter; locking means operably associated with the housing for securely mounting the housing against rotation relative to the oil filter; and hand wrenching means operably associated with the housing to enable a user to physically grip and rotate the filter in either direction for tightening or loosening same relative to the automobile engine or the like.

The hand wrenching means is configured to the shape of a user's hand, and is preferably integrally connected relative to the housing. The hand wrenching means comprises a series of circumferentially spaced projections extending longitudinally beyond the housing, generally from at least a partially closed end of the housing opposite the open end of the housing. In a preferred embodiment, there may be four equally spaced projections extending from a downwardly and outwardly tapering at least partially closed end of the housing. Each of the finger engaging portions may include opposed inwardly-to-outwardly tapering side walls. The configuration, arrangement and dimensioning of the finger engaging projections is such as to also facilitate the receipt of a small pry tool to break loose stuck or overtightened oil filters, when needed.

The locking means may include a circumferential clamp with associated fastener mounted about the housing for securing or loosening the housing relative to the oil filter. The housing may include flexible fingers about which the circumferential clamp extends for applying tightening or loosening pressure relative to the oil filter.

Another form of locking means may include at least one pivoting lever mounted to the housing with at least one cam locking surface for engaging the oil filter. Each pivoting lever may include a differently sized cam locking surface for engaging different diameter oil filters dependent upon the particular pivotal location of the pivoting lever. The pivoting lever may be pivotally mounted to the finger engaging projections and extend at least partially within a complementary configured recess provided in the associated finger engaging projection. In the preferred embodiment there may be one or more pivoting levers. At an outer free end of each pivoting lever, a finger engaging operating tab may also be provided.

Still another locking means may include internal locking surfaces integrally formed in the inner wall of the housing which correspond in number, configuration and arrangement relative to flat surfaces provided adjacent an outwardly extending end of oil filters.

These and other objects and advantages of the present invention will become apparent from the description that is to follow.

BRIEF DESCRIPTION OF THE DRAWINGS

In the drawings.

Corresponding reference numerals will be used throughout the various figures of the drawings.

DESCRIPTION OF THE PREFERRED EMBODIMENT

Figure 1:
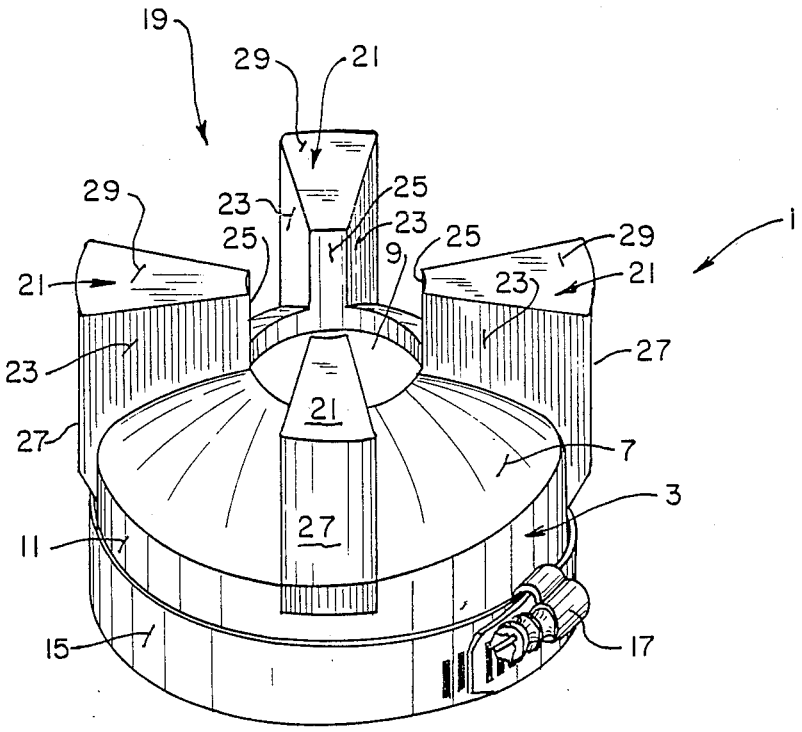
FIG. 1 is a perspective view of one form of oil filter accessory or wrench incorporating a circumferential clamp device, which is constructed in accordance with the teachings of the present invention, as further illustrated in FIGS. 3–6 below.
Figure 2:
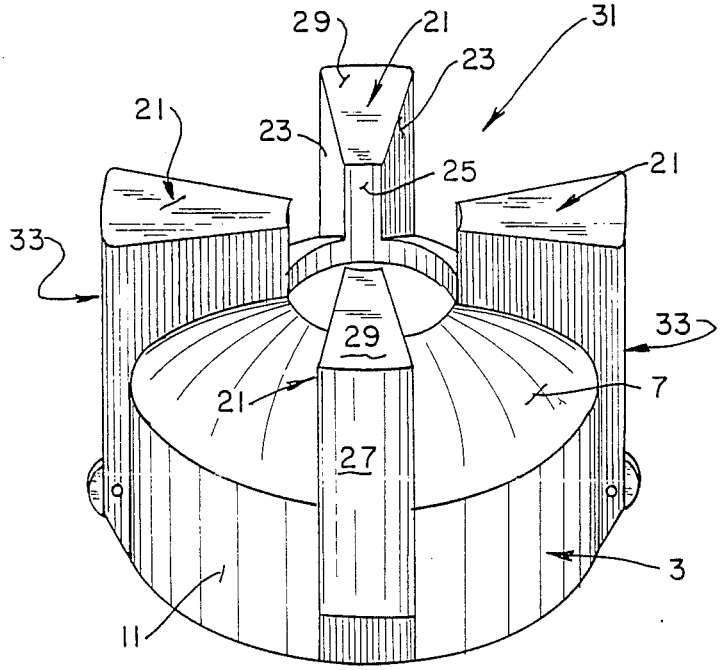
FIG. 2 is a perspective view of another form of oil filter accessory or wrench, incorporating pivoting locking lever(s), also further illustrated in FIGS. 7–10 below.

The following detailed description illustrates the invention by way of example with respect to the principles of the invention. This description will clearly enable one skilled in the art to make and use the invention, and describes several embodiments, adaptions, variations, alternatives and uses of the invention, including what we presently believe is the best mode of carrying out the invention.

FIGS. 1 and 3–6 illustrate one form of oil filter accessory or wrench, FIGS. 2 and 7–10 illustrate a second embodiment of oil filter accessory or wrench, and FIGS. 11–14 illustrate a third embodiment of oil filter accessory or wrench. It will be further apparent from the discussion that follows that various other types of oil filter accessory or wrench designs may be employed, other than those illustrated in the drawings.

Figure 3:
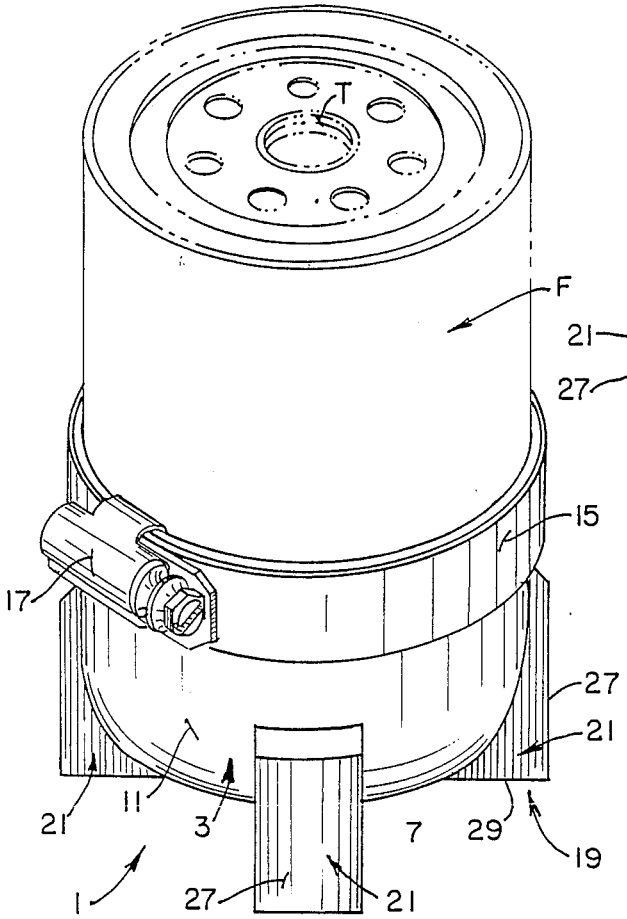
FIG. 3 is a perspective view illustrating the oil filter accessory or wrench embodiment of FIG. 1 in position relative to a canister-type oil filter, for installing or removing same.
Figure 4:
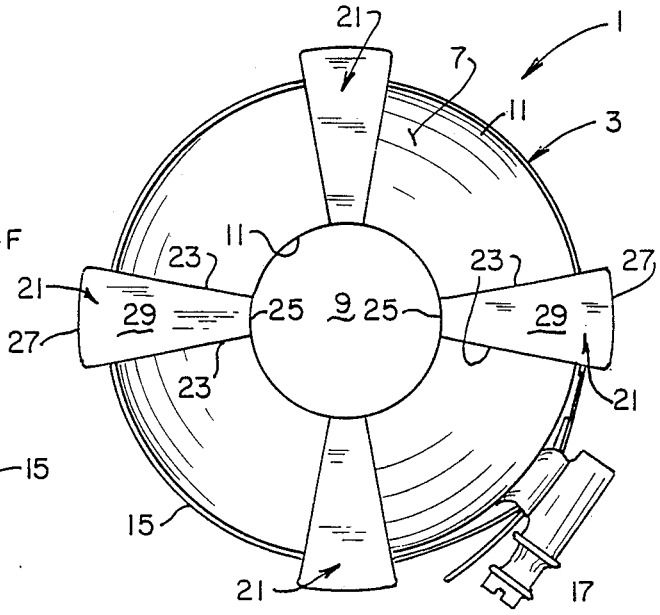
FIG. 4 is a bottom plan view of the oil filter accessory or wrench illustrated in FIG. 3.
Figure 5:
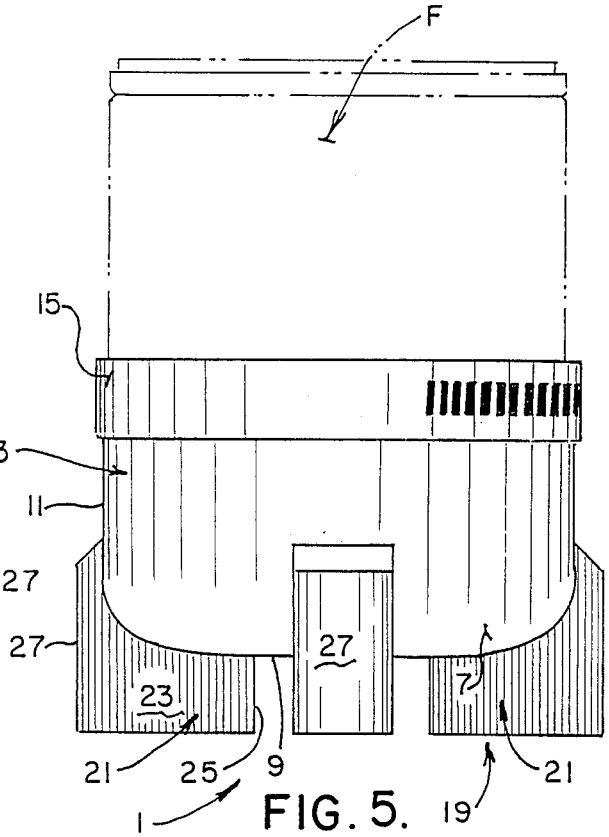
FIG. 5 is a side elevational view of the oil filter accessory or wrench illustrated in FIGS. 3 and 4.
Figure 7:
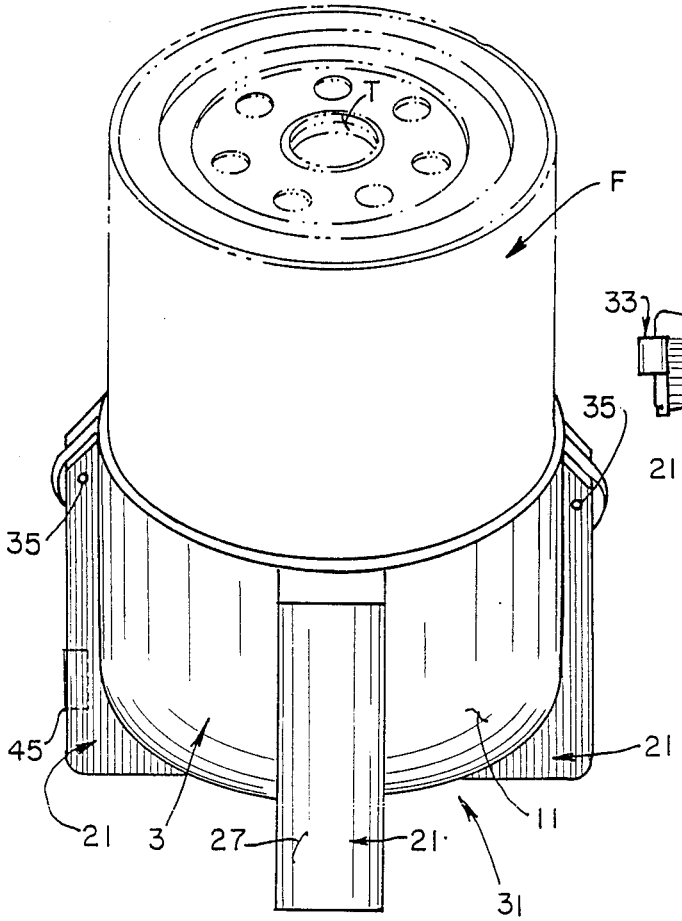
FIG. 7 is a perspective view of the other form of oil filter accessory or wrench shown in FIG. 2 of the drawings, and also being mounted relative to an oil filter for installing or removing same.
Figure 8:
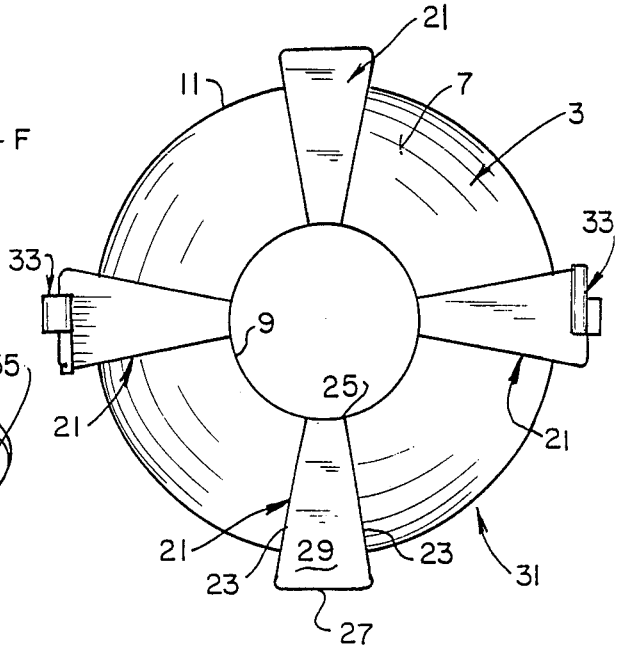
FIG. 8 is a bottom plan view of the oil filter accessory or wrench illustrated in FIG. 7.

In the oil filter accessory or wrench shown in FIGS. 1 and 3–6 of the drawings, it will be seen that the oil filter accessory, generally identified by the numeral 1, includes a housing 3 having at least one open end 5 adapted to fit over an oil filter F, as best illustrated in FIGS. 3 and 5 of the drawings. The oil filters F are of the canister-type having a threaded opening T at one end thereof for complementary threaded engagement relative to a hollow threaded stud (not shown) of an engine block, as is well known.

The oil filter accessory 1 is adapted to fit over the other end of the oil filter F, to facilitate installation and removal of the oil filter F relative to an engine block. As shown in FIGS. 3 and 5 of the drawings, the oil filter accessory 1 is shown as being positioned below the oil filter F, although in most downsized front wheel drive passenger cars, the oil filter is mounted horizontally. Regardless of mounting, the oil filter accessory 1 will operate in any of such positions.

Opposite the open end 5 of the oil filter accessory 1 is a partially closed end 7 with a smaller central opening 9 extending therethrough. From the smaller central opening 9, the closed end 7 tapers downwardly and outwardly to a circumferential or cylindrical wall 11, the outer free end of which circumscribes and defines the open end 5 of the housing 3.

Figure 6:
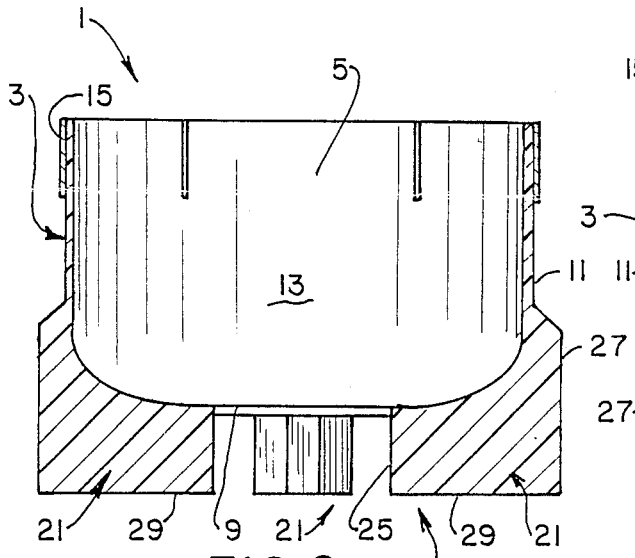
FIG. 6 is a vertical sectional view of the oil filter accessory or wrench embodiment illustrated in FIGS. 3 through 5.

As seen in FIG. 6 of the drawings, the interior configuration 13 of the housing 3 defined by the at least partially closed end wall 7 and the circumferential or cylindrical wall 11, is constructed to be complementary configured relative to an oil filter F, in order to enable the oil filter F to be readily received within the complementary interior configuration 13 of the housing 3.

For locking or securing the housing 3 of the oil filter accessory 1 relative to the oil filter F, so as to prevent any relative rotation therebetween, the oil filter accessory 1 in the FIGS. 1 and 3–6 embodiment illustrates a circumferential clamp 15 which is positioned about the cylindrical or circumferential wall 11 of the housing 3. The circumferential clamp 15 may be secured to the cylindrical or circumferential wall 11 such as by rivets or the like and includes an associated fastener and tightening mechanism 17, as is well known, for constricting or enlarging the circumferential clamp 15 relative to the cylindrical or circumferential wall 11 of the housing 3. The housing cylindrical or circumferential wall 11 may be provided with a series of slits in the area about which the circumferential clamp 15 extends, thus providing a series of flexible fingers to allow the cylindrical or circumferential wall 11 to be constricted and forced against the complementary side wall of the oil filter F in a clamped and secured relationship, when the circumferential clamp 15 is appropriately tightened by the associated fastener and tightening mechanism 17, as is well known.

With the housing 3 of the oil filter accessory 1 suitably securely mounted to the oil filter F so as to prevent relative rotation therebetween, the oil filter F may be rotated in the desired direction for installing or removing the oil filter F relative to the engine block. For this purpose, the oil filter accessory 1 includes hand wrenching means generally identified at 19, which are operably associated with the housing 3 in order to enable a user to physically grip and rotate the oil filter F in either direction for tightening or loosening same relative to the engine block.

Specifically, the hand wrenching means 19 comprises a series of circumferentially spaced and longitudinally extending integral finger gripping projections 21 which extend from the at least partially closed end 7 of the housing 3. The finger gripping projections are configured, arranged and dimensioned to enable a user to physically grip and rotate the oil filter in the desired direction.

It will be noted that the finger engaging projections are shown in FIGS. 1 and 3–6 as including four equally spaced finger engaging projections, approximately 90° apart from one another, which are integrally connected to and longitudinally extend outwardly from a downwardly and outwardly tapering closed end 7 of the housing 3. Each finger engaging projection includes opposed inwardly-to-outwardly tapering side walls 23, 23 which are connected to an inner wall 25 in the vicinity of the central opening 9 and connected along an outer peripheral wall 27 which extends generally parallel to the cylindrical or circumferential wall 11. A generally horizontal or flat upper wall 29 connects the tapering side walls 23, 23, inner wall 25 and outer wall 27, and the upper wall 29 of adjacent finger engaging projections 21 are generally co-planar with one another.

The aforementioned configuration, arrangement and dimensioning of the finger engaging projections 21 relative to the downwardly and outwardly tapering closed end wall 7 of the housing 3 provides exposed, relatively substantial gripping surfaces, in order that a user may impart necessary force to the oil filter F, during tightening or loosening the oil filter F relative to an engine block. In those instances where an oil filter F may be frozen-in-place, a pry bar tool (not shown) may be placed in the open spaces between opposed finger engaging projections 21, and the finger engaging projections 21 may then be used to convey a greater force via the pry bar to the housing 3, and thus to the oil filter F, in breaking apart the frozen-in-place threaded connection between the oil filter F and the engine block. Where the oil filter F is still hot, the housing 3, coupled with the spaced finger engaging projections 21, serve as suitable insulators to the hand of a user, so as to reduce heat from being transferred to the user.

In order to form the oil filter accessory 1 with the various component parts described above, the oil filter accessory 1 is preferably molded as a one-piece unit with the integral finger engaging projections 21, as illustrated in FIGS. 1 and 3–6 of the drawings, from a suitable and durable plastic or metal material, of which there are many. Subsequently, the circumferential clamp 15 is secured or otherwise attached to the cylindrical or circumferential wall 11, thereby providing the locking means for resisting relative rotation between the oil filter F and oil filter accessory 1, when suitable circumferential clamping force is applied through the circumferential clamp 15.

Other types of locking means may be employed in lieu of the circumferential clamp 15, and an example of this is disclosed by the embodiment shown in FIGS. 2 and 7–10 of the drawings. The oil filter accessory 31 shown in FIGS. 2 and 7–10 of the drawings contain many of the same component parts as the oil filter accessory 1 in the FIGS. 1 and 3–6 embodiment, and similar reference numerals will be used to designate like parts in both embodiments. Thus, the housing 3 includes at least one open end 5 adapted to fit over an oil filter F with the partially closed end wall 7 having a central opening 9. A series of four equally spaced finger engaging projections 21 extend upwardly from the partially closed end wall 7 and are constructed, arranged and dimensioned in the same manner as in the oil filter accessory 1 of the FIGS. 1 and 3–6 embodiment.

The principal difference between the oil filter accessory 31 and the oil filter accessory 1 is that the oil filter accessory 31 has a different type of locking means other than the circumferential clamp 15 in the oil filter accessory 1. Specifically, the locking means is in form of a pivoting locking lever(s) 33, 33 which are pivotally mounted at 35, 35 within a complementary configured recess 37, 37 provided in opposed finger engaging projections 21, 21.

Figure 10:
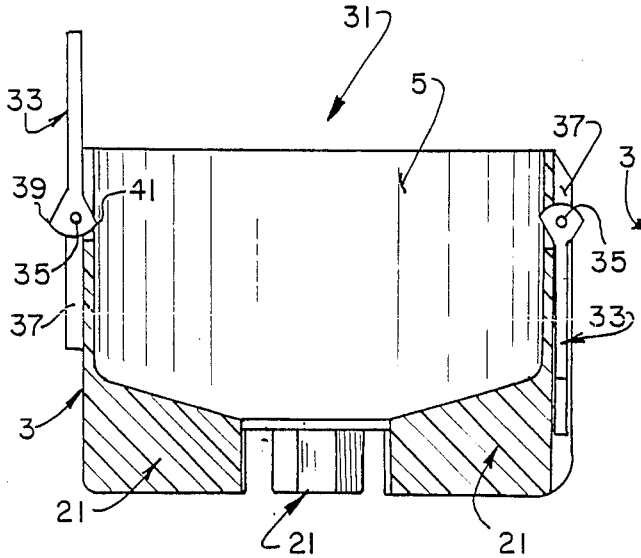
FIG. 10 is a vertical sectional view further showing the oil filter accessory or wrench illustrated in FIGS. 7 through 9 of the drawings.
Figure 9:
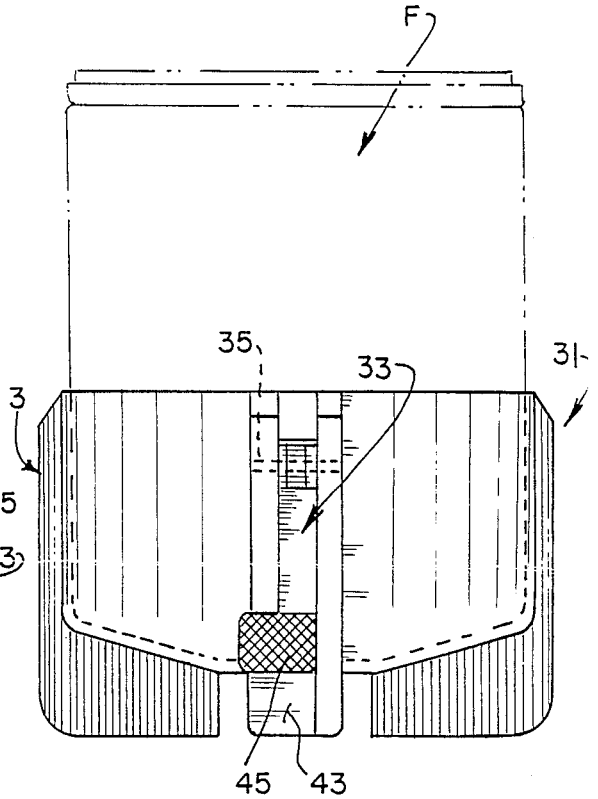
FIG. 9 is a side elevational view of the oil filter accessory or wrench shown in FIG. 7 and 8.

As best seen in FIG. 10 of the drawings, each of the pivoting locking levers 33, 33 are adapted to be moved into two locking positions, one in which the locking lever is pivoted away from the housing 3, as shown on the left hand side of FIG. 10, and the other where the pivoting locking lever 33 is moved in juxtaposed position relative to the housing 3, as shown on the right hand side of FIG. 10. A pair of locking surfaces 39, 41 of different dimension are formed as tapered locking or cam surfaces in the vicinity of each pivot 35. As the pivoting locking lever(s) 33 are moved in either of the two above mentioned locking positions, either one of the two locking surfaces 39 or 41 is positioned into engagement with the oil filter. One of the locking surfaces 39 or 41 may be constructed to engage an oil filter F of slightly smaller diameter, and thus one of the two locking surfaces 39 or 41 must be sufficiently enlarged to take up any dimensional differences. In the same way, the other locking surface may have a smaller shape or configuration for engaging a greater diameter oil filter F. The two locking surfaces 39 and 41 of each pivoting locking lever 33 are thus designed to be moved into forcible engagement with an associated oil filter F, in order to securely mount the housing 3 and restrain same from relative rotation relative to the oil filter F. At the outer free end of each pivoting locking lever 33, 33 is a finger engaging and operating tab 43 which may have an outer knurled surface 45 to facilitate gripping thereof.

It will be appreciated that the operation of the oil filter accessory 31, and mounting and securing same to an oil filter F can be accomplished by simply moving the pivoting locking levers 33, 33 to the desired locking location, based on instructions given to the user, in order to lock and secure the housing 3 of the oil filter accessory 31 relative to an oil filter F. Since no additional tools are required to lock the housing 3 of the oil filter accessory 31 to an oil filter F, the speed and efficiency in using the oil filter accessory 31 will be understood.

Still another type of locking means may be employed in lieu of the circumferential clamp 15 shown in FIGS. 1 and 3–6 or the pivoting locking levers 33, 33 shown in FIGS. 2 and 7–10 of the drawings. The oil filter accessory 51 shown in FIGS. 11–14 of the drawings contain many of the same component parts as the oil filter accessory 1 (FIGS. 1 and 3–6) as well and the oil filter accessory 31 (FIGS. 2 an 7–10), and similar reference numerals will again be used to designate like parts in all three embodiments. In this regard, note that the housing 3 includes an open end 5, a closed end wall 7, and a series of four equally spaced finger engaging projections 21 which extend upwardly from the closed end wall 7 and are similarly constructed, arranged and dimensioned as the oil filter accessory 1 (FIGS. 1 and 3–6) and the oil filter accessory 31 (FIGS. 2 and 7–10).

The oil filter accessory 51 in FIGS. 11–14 differs from oil filter accessories 1 and 31 by using a different type of locking means in the form of internal locking surfaces to correspond in number, shape and arrangement relative to flat surfaces provided adjacent an outwardly extending end of most oil filters.

Figure 12:
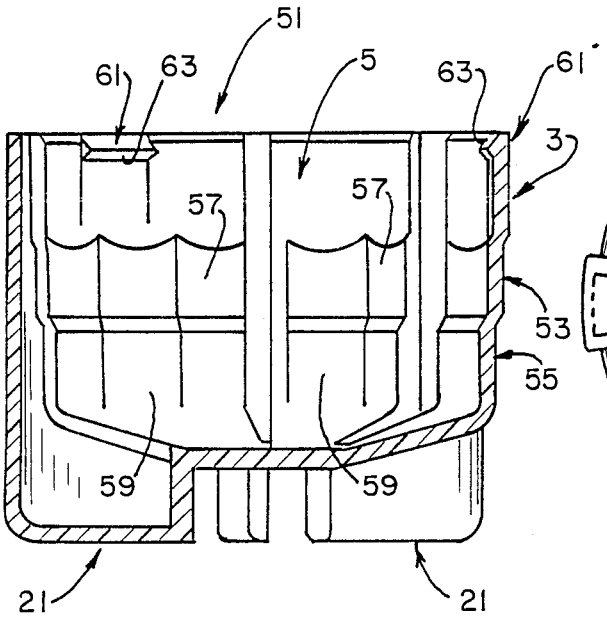
FIG. 12 is a vertical sectional view of the oil filter accessory or wrench shown in FIG. 11.
Figure 13:
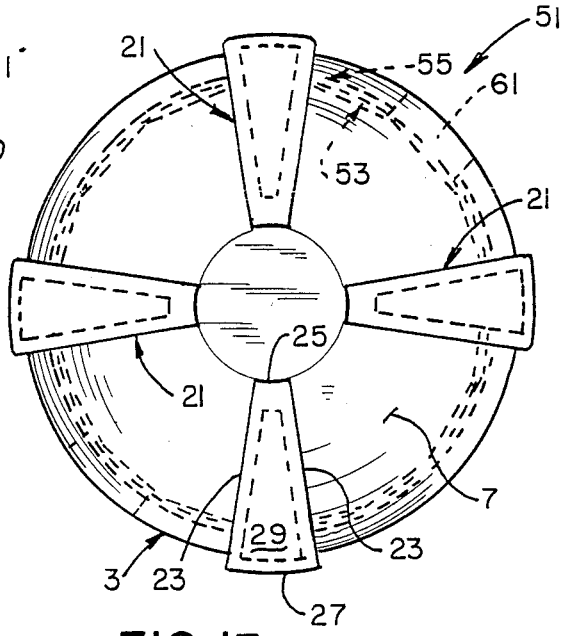
FIG. 13 is a bottom plan view of the oil filter accessory or wrench shown in FIGS. 11–12.
Figure 11:
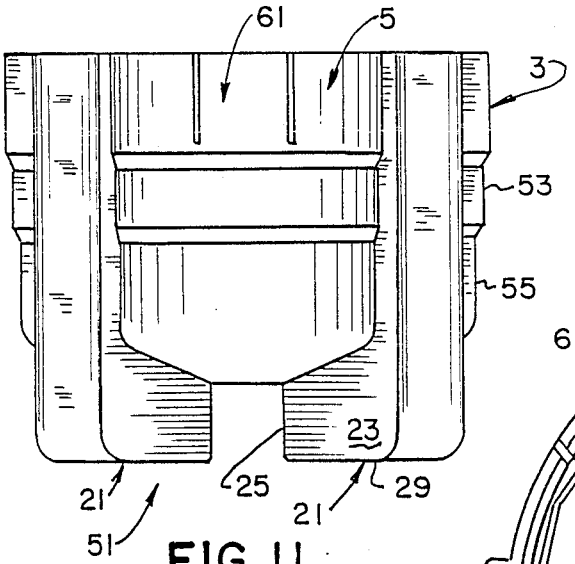
FIG. 11 is a side elevational view of still another form of oil filter accessory or wrench.
Figure 14:
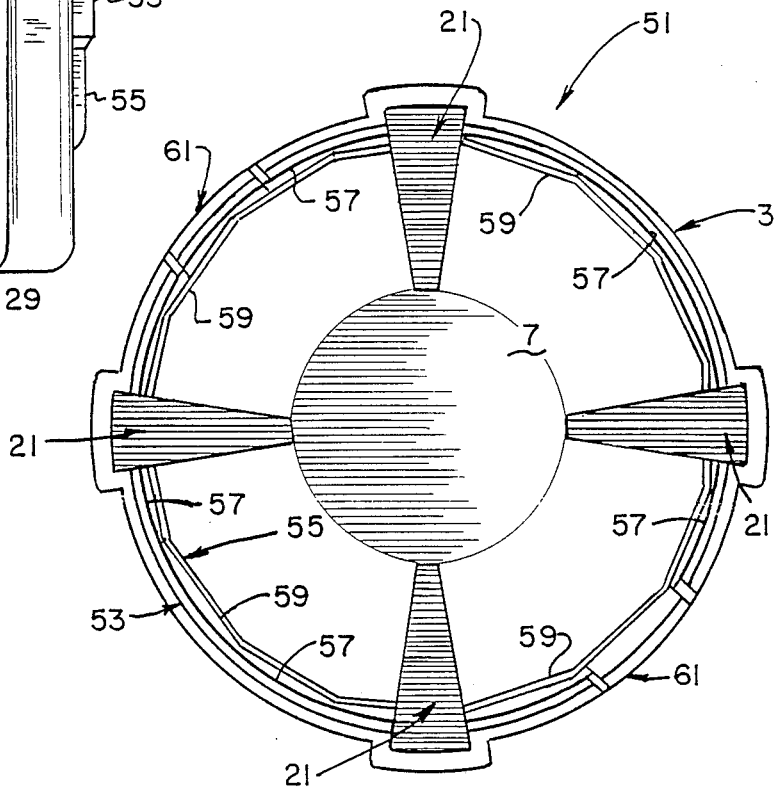
FIG. 14 is an enlarged top plan view of the oil filter accessory or wrench shown in FIGS. 11–13.

Thus, the oil filter accessory 51 illustrates, as best seen in FIGS. 11–12, upper and lower locking means 53, 55, of different diametrical extent, for complementary mating engagement with oil filters of the same corresponding shape and size. There are two principal oil filter manufacturers in the United States, and the upper and lower integral locking means 53, 55 are constructed to engage these two different types of oil filters. The integral locking means 53, 55 are axially offset or stepped with respect to one another, as shown in FIGS. 11–12.

Each of the locking means 53, 55 include a series of circumferentially spaced internal locking surfaces 57, 59, respectively, which correspond in number, shape and arrangement relative to the flats provided adjacent an outer free end of the two principal oil filters currently manufactured.

To assist in securing the oil filter accessory 51 to an oil filter, one or more flexible gripping fingers 61 are formed in the housing 3 adjacent the open end 5. As will be best seen in FIG. 12 of the drawings, the flexible gripping fingers 61 each have an inwardly directed shoulder 63 for gripping engagement with the side wall of an oil filter to hold the oil filter accessory 51 in position.

Use of the oil filter accessory 51 is easily accomplished by simply mounting the accessory 51 over a particular sized oil filter, enabling the integral locking means 53 with internal locking surfaces 57 or integral locking means 55 with internal locking surfaces 59 to be brought into complementary mating engagement with the flats at an outer end of an oil filter. When register or mating engagement is thus achieved, the gripping fingers 61 will assist in gripping the side wall of an oil filter in order to hold the oil filter accessory 51 in place. Removal or insertion of an oil filter may then take place by gripping the spaced finger engaging projections 21 to lock or unlock and oil filter, as may be desired.

In view of the above, it will be seen that the three embodiments of the present invention, as shown in FIGS. 1 and 3–6, FIGS. 2 and 7–10, and FIGS. 11–14 are representative examples of the present invention through which the several objects and features of this invention are achieved and other advantageous results obtained.

As various changes could be made in the above constructions and embodiments without departing from the scope of the invention, it is intended that all matter contained in the above description or shown in the accompanying drawings shall be interpreted as illustrative and not in a limiting sense.

We claim:

1. An oil filter accessory to facilitate installation and/or removal of an oil filter from an automobile engine or the like, comprising:

a housing having at least one open end adapted to fit over an oil filter;

locking means operably associated with said housing for securely mounting said housing against rotation relative to said oil filter; and hand wrenching means operably associated with said housing to enable a user to physically grip and rotate said filter in either direction for tightening or loosening same relative to said automobile engine or the like, said hand wrenching means comprising a series of spaced finger gripping projections integral with and extending circumferentially about said housing, each finger gripping projection tapering inwardly on opposite sides thereof from an outermost surface to an innermost surface which is laterally offset from the innermost surfaces of said other projections, and each finger gripping projection also extending longitudinally beyond the housing for a sufficient distance to enable the fingers of a user's hand to grip the finger gripping projections for tightening and loosening of an oil filter relative to the automobile engine.

2. The oil filter accessory as defined in claim 1 wherein said circumferentially spaced projections extend from at least a partially closed end of said housing generally opposite said open end.

3. The oil filter accessory as defined in claim 2 wherein there are four equally spaced projections extending from said at least partially closed end of said housing, each opposing pair of projections being in general alignment with one another.

4. The oil filter accessory as defined in claim 3 wherein said at least partially closed end of said housing tapers downwardly and outwardly from the innermost surface to the outermost surface of each projection.

5. The oil filter accessory as defined in claim 1 wherein said locking means is attached to said housing.

6. The oil filter accessory as defined in claim 5 wherein said locking means includes adjustment means for oil filters of different diametrical dimensions.

7. The oil filter accessory as defined in claim 6 wherein said adjustment means includes a circumferential clamp with an associated fastener and tightening mechanism for tightening or loosening said circumferential clamp.

8. The oil filter accessory as defined in claim 7 wherein said circumferential clamp circumferentially surrounds said housing about circumferentially spaced flexible fingers formed in said housing to facilitate gripping an oil filter upon tightening or loosening of said circumferential clamp.

9. The oil filter accessory as defined in claim 6 wherein said adjustment means includes at least one pivoting lever mounted to said housing and having differently sized cams on opposite surfaces thereof for engaging different diameter oil filters.

10. The oil filter accessory as defined in claim 9 wherein said adjustment means includes a pair of opposed pivoting levers each constructed with differently sized cams on opposite surfaces thereof for engaging different diameter oil filters.

11. The oil filter accessory as defined in claim 10 wherein each pivoting lever has a transverse finger engaging and operating tab at an outer free end thereof to facilitate pivoting movement of each pivoting lever.

12. The oil filter accessory as defined in claim 6 wherein said locking means includes integral, upper and lower axially spaced internal and circumferentially extending locking surfaces corresponding in number, shape and arrangement to flats formed on different oil filter sizes.

13. The oil filter accessory as defined in claim 12 wherein said locking means further includes flexible gripping fingers for engaging an oil filter sidewall to hold the oil filter accessory in position.

14. An oil filter accessory facilitates installation and/or removal of an oil filter from an automobile engine or the like, comprising:

a housing having at least one open end adapted to fit over an oil filter;

locking means operably associated with said housing for securely mounting said housing against rotation relative to said oil filter; and a series of circumferentially spaced and longitudinally extending integral finger gripping projections which extend from at least a partially closed end of said housing generally opposite said housing open end, said finger gripping projections being configured, arranged and dimensioned to enable a user to physically grip and rotate said filter in either direction for tightening or loosening same relative to an automobile engine or the like, each of said finger gripping projections comprising a series of spaced finger gripping projections integral with and extending circumferentially about said housing, each finger gripping projection tapering inwardly on opposite sides thereof from an outermost surface to an innermost surface which is laterally offset from the innermost surfaces of said other projections, and each finger gripping projection also extending longitudinally beyond the housing for a sufficient distance t enable the fingers of a user's hand to grip the finger gripping projections for tightening and loosening of an oil filter relative to the automobile engine.

15. The oil filter accessory as defined in claim 14 wherein said at least partially closed end of said housing tapers downwardly and outwardly from a central area thereof, and said projections comprise four equally spaced finger engaging projections which longitudinally extend outwardly from said downwardly and outwardly tapering at least partially closed end of said housing.

16. The oil filter accessory as defined in claim 15 wherein each of said finger engaging projections include opposed inwardly-to-outwardly tapering side walls.

17. The oil filter accessory as defined in claim 16 wherein said finger engaging projections are configured, arranged and dimensioned relative to one another for the receipt of a small pry tool to break loose stuck or overtightened oil filters.

18. An oil filter accessory to facilitate installation and/or removal of an oil filter from an automobile engine or the like, comprising;

a housing have at least one open end adapted to fit over an oil filter;

locking means operably associated with said housing for securely mounting said housing against rotation relative to said oil filter, said locking means including at least one pivoting lever mounted to said housing and including a cam locking surface for engaging said oil filter; and hand wrenching means operably associated with said housing to enable a user to physically grip and rotate said filter to either direction for tightening or loosening same relative to said automobile engine or the like.

19. The oil filter accessory as defined in claim 18 wherein each pivoting lever includes differently sized cam locking surfaces for engaging different diameter oil filters dependent on the particular pivot location of said pivoting lever.

20. The oil filter accessory as defined in claim 19 wherein each said pivoting lever is pivotally mounted to one of said finger engaging projections.

21. The oil filter accessory as defined in claim 20 wherein each pivoting lever pivotally mounted to one of said finger engaging projections is substantially received within a complementary configured recess provided in said finger engaging projection in one pivotal position of each said pivoting lever.

22. The oil filter accessory as defined in claim 21 wherein each pivoting lever includes a finger engaging and operating tab at an outer free end thereof.

23. The oil filter accessory as defined in claim 22 wherein there are two opposing pivoting levers for engaging an oil filter on generally opposite sides through the respective associated cam surfaces of said pivoting levers.

24. An oil filter accessory to facilitate insertion and/or removal of an oil filter from an automobile engine or the like, comprising:

a housing having at least one upper end adapted to fit over an oil filter;

locking means operably associated with said housing for securely mounting said housing against said rotation relative to said oil filter, said locking means including integral upper and lower axially spaced and circumferentially extending internal locking surfaces corresponding in number, shape and arrangement to flats formed in a corresponding upper or lower position on one of two different oil filter sizes, and hand wrenching means operably associated with said housing to enable a user to physically grip and rotate the filter in either direction for tightening or loosening said relative to said automobile engine or the like, said hand wrenching means comprising a series of spaced finger gripping projections integral with and extending circumferentially about said housing, each finger gripping projection tapering inwardly on opposite sides thereof from an outermost surface to an innermost surface which is laterally offset from the innermost surfaces of said other projections, and each finger gripping projection also extending longitudinally beyond the housing for a sufficient distance to enable the fingers of a user's hand to grip the finger gripping projections for tightening and loosening of an oil filer relative to the automobile engine.

25. The oil filter as defined in claim 24 wherein said locking means further includes flexible gripping fingers for engaging an oil filter sidewall to hold the oil filter accessory in position, while one of said upper and lower axially spaced and circumferentially extending locking surfaces engage corresponding flats on one of said different sized oil filters.

* * * * *